United States Patent [19]

Lévêque et al.

[11] Patent Number: 4,735,379

[45] Date of Patent: Apr. 5, 1988

[54] SYSTEM FOR AUTOMATICALLY GUIDING A MISSILE AND MISSILE PROVIDED WITH SUCH A SYSTEM

[75] Inventors: Michel Lévêque, Meudon; Jean-Paul Guivarch, Bagneux; Alain Appriou, Orsay; François Le Chevalier, Bourg-La-Reine; Régis Barthelemy, Les Ulis, all of France

[73] Assignee: Aerospatiale Societe Nationale Industrielle, Paris, France

[21] Appl. No.: 928,394

[22] Filed: Nov. 10, 1986

[30] Foreign Application Priority Data

Nov. 18, 1985 [FR] France ..... 85 17009

[51] Int. Cl.[4] ..... F41G 7/22

[52] U.S. Cl. ..... 244/3.19; 244/3.15

[58] Field of Search ..... 244/3.19, 3.15

[56] References Cited

U.S. PATENT DOCUMENTS

| | | | |
|---|---|---|---|
| 3,779,492 | 12/1973 | Grumet | 244/3.17 |
| 3,974,328 | 8/1976 | Thomas et al. | 178/6.8 |
| 4,021,801 | 5/1977 | Chernick | 244/3.19 |
| 4,108,400 | 8/1978 | Groutage et al. | 244/3.19 |
| 4,136,343 | 1/1979 | Heffner et al. | 244/3.19 |

FOREIGN PATENT DOCUMENTS

| | | |
|---|---|---|
| 0039702 | 5/1981 | European Pat. Off. . |
| 2943312 | 2/1981 | Fed. Rep. of Germany . |
| 2949453 | 11/1981 | Fed. Rep. of Germany . |
| 2400781 | 3/1979 | France . |
| 2402971 | 4/1979 | France . |
| 2494870 | 5/1986 | France . |

OTHER PUBLICATIONS

Decision Theunetic Target Classification by J. P. Toomey & C. L. Bennett—Paper at 1980 Symposium of IEEE on Antennas—and Propagation.

*Primary Examiner*—Charles T. Jordan

*Attorney, Agent, or Firm*—Fisher, Christen & Sabol

[57] ABSTRACT

This invention relates to a multi-target guiding system for missile, wherein it is provided with an electronic scanning antenna; it effects a classification of the targets by order of priority and orients the missile by controlling the control surfaces towards the target of highest priority. During classification, the system causes the direction of advance of said missile to vary in order to maintain said targets in its domain of action for as long as possible.

9 Claims, 3 Drawing Sheets

SYSTEM FOR AUTOMATICALLY GUIDING A MISSILE AND MISSILE PROVIDED WITH SUCH A SYSTEM

The present invention relates to a system for automatically guiding a missile, of the active electromagnetic homing type. It is particularly, but not exclusively, appropriate for air-sea or sea-sea missiles.

Active electromagnetic homing heads for automatically guiding a missile towards a target, in particular a sea target, are already known. Such known homing heads use two test channels exploiting signals issuing from a mechanical scanning antenna, in order to deliver to the missile an angular deviation measuring signal enabling it to servo-control its trajectory in the direction of a detected target. This phase of automatic tracking of the target is generally preceded by a search phase enabling the homing head to detect the echo or echos present in its range of search and possibly to make a rapid choice of these echos, as a function of simple criteria, such as, for example, the amplitude or width thereof. During this search phase, no order of guiding is sent to the missile, with the result that this phase must be short (generally less than 1 second), which therefore does not allow a permanent parallel analysis of all the echos present in the range of search, nor, therefore, a fine classification of these echos and potential targets.

Guiding of the missiles by the known active electromagnetic homing heads is thus effected by servo-control of the missile on a given target. Once said missile is servo-controlled on said target, it can no longer be directed towards another target without running the risk of missing, on the one hand, the target towards which the missile was firstly directed since it is voluntarily diverted therefrom to be directed at the last moment onto another and, on the other hand, the last target indicated, as the latter will have been designated too late by the homing head.

It is an object of the present invention to improve the active homing heads so that they analyze finely a range of targets, possibly comprising window or chaff and jammers, and choose the target of highest priority.

To this end, according to the invention, the system for guiding a missile intended to reach a target chosen from several targets located in a geographical region where they may move about, this system comprising observation means scanning a range of action of which the lateral limits are determined by the possibilities of scanning of said observation means and by the manoeuvring possibilities of said missile and of which the limit in depth is at the most equal to the maximum range of said observation means, as well as computer means for processing the information delivered by said observation means, said missile being provided with steering controls adapted to be controlled by said computer means, is noteworthy in that:

said observation means are of the type with electronic scanning antenna and successively and permanently scan the whole of a plurality of elementary zones fictitiously subdividing that part of said geographical region covered at each instant by said range of action;

said computer means are associated with memory means in which are pre-recorded the electronic images of potential targets classified by order of decreasing priority;

said computer means determine the positions of the targets located at each instant in said range of action;

said computer means act on the steering controls of said missile to cause said range of action to slide with respect to said geographical region in order to delay the departure from the range of observation of at least certain of the targets reaching the lateral limits thereof;

said computer means continuously classify the targets located in said geographical region by comparing the electronic images thereof furnished by said observation means with said pre-recorded images; and finally, said computer means act on said steering controls to guide said missile towards the target of highest priority determined by said classification.

Thanks to the high rate of scanning of an electronic antenna and to the delay made to the departure of the targets from the range of observation, the system according to the invention thus takes advantage of an optimum period of time (despite the often high speed of the missile) to proceed with the detection and fine classification of the targets by comparison with the recorded electronic images, and to direct the missile towards the target of highest priority.

In order to lighten the computing work, prior to the determination of the trajectories followed by the targets, to a maximum, said computer means preferably effect a pre-classification of the targets by order of importance. Such pre-classification may for example be effected by means of the amplitude of the echos returned by said targets and it enables the positions only of the most important targets to be determined.

In order to establish only one V.H.F. link between said antenna and the rest of the guiding system, the latter advantageously comprises a V.H.F. emitter. controlled by said computer means and supplying said antenna via a circulator, which, furthermore, addresses to said computer means the signals received from said targets by said antenna. It is also advantageous if scanning of said antenna be controlled by said computer means.

The electronic scanning antenna may be of the type described in the following patent Nos.: FR-A-2 400 781, FR-A-2 494 870 and No. EP-A-0039702. It may be:

either of the monoplane type, or of the monoplane type but comprising, in addition, a mechanical device for decoupling the position of the antenna in elevation from the movements of the missile, or of the two-plane type enabling the beam to be electronically decoupled from the movements of the missile in elevation.

Scanning by the antenna is preferably effected in accordance with a pseudo-random process, enabling certain jammers to be avoided.

For each antenna position, the system according to the invention emits a V.H.F. signal (a narrow pulse for example) and it then digitalizes the amplitude of the return signal after detection, and possibly integration. At that level, it is advantageous to have the digitizer step preceded by a logarithmic amplifier, in order to reduce the number of necessary bits, taking into account the desired dynamics.

The system therefore permanently produces radar charts, by quantifying the amplitude of the signal received from each elementary zone.

A digital processing, such as described in patent Nos. FR-A-2 402 971 and FR-A-2 494 870, then makes it possible, scanning after scanning, to establish tracks characterized by their energy and corresponding to a maximum possible evolution of the targets from one scanning to the other.

In parallel, the signal received around the tracks thus created is exploited more finely: one calculates the functions of autocorrelation of the responses in amplitude obtained in successive elementary zones and compared, in accordance with mathematical laws, with characteristic functions obtained by learning, in particular either from real targets or from measurements made on models and extrapolated, or by methods based on a mathematical modelization of the targets.

To that end, for example, with a radar presenting characteristics (frequency, resolution, distance, etc.) which are identical or as close as possible to those of said observation means of the missile, impulsive responses of real targets, possibly in different presentations (in attitude) are recorded and said impulsive responses are subsequently subjected to autocorrelation treatments comparable to those effected by the homing head. The results of this treatment constitute the pre-recorded electronic images.

In order to obtain these images, said targets may also be reconstituted in the form of reduced-scale models and measures of the type mentioned above are effected in an anechoic chamber at transposed frequency (in the ratio of reduction of the models).

A classification of the targets and of the chaff or window, depending on their probability of being the target designated, is thus made.

The type of continuous scanning made by the invention, associated with the multi-target guiding, presents numerous advantages over the homing heads known up to the present time, namely:

the sensitivity of detection of the echos is improved, as the antenna returns permanently in all the directions of the range of search, thus allowing a longer integration of the signals. This is particularly advantageous in the case of sea targets, as the spectrum of fluctuation of these latter extends to very low values (some tenths of hertz);

the analysis and parallel, continuous classification of all the echos of the range makes it possible, a priori, to disregard none, whilst having considerable time available for analysis (which is useful, taking into account the spectrum of fluctuation mentioned above). This is particularly advantageous in the case of long-distance firing, for which the errors on the designation of target on the one hand, and the imprecisions of inertial flight on the other hand, mean that the designated target may be located in random manner in the whole range of search displayed;

with regard to the jammers and the listening-in system associated therewith, the fact that the illumination of the target is intermittent may delay and even prevent the response of a jammer.

Furthermore, the fact of having available at any instant a maximum of analyzed and memorized information for the whole range of search, promotes the location of the target chosen leaving the sphere of jamming. This is particularly advantageous in the event of a jammer being triggered off after the emission of the homing head.

Moreover, the present invention simplifies production of the homing head, namely:

one reception channel only, elimination of the position detectors and of the mechanical antenna decoupling systems, elimination of the V.H.F. swivel joints.

The pre-recorded electronic images preferably correspond, at least as far as the potential targets of highest priority are concerned, to several different attitudes of said targets with respect to the missile. For example, the guiding system according to the invention not only identifies the targets, but knows their relative angular position with respect to the missile. Instead of guiding the missile towards the brightest point of the priority target, it may therefore conduct said missile towards a more vulnerable point of impact thereof. This favourable point of impact may be chosen by a decision program within the guiding system according to the invention or by display before said missile is fired.

For example, this point of impact is determined as being the barycentre of a plurality of bright points (not necessarily the brightest) of said target, the coefficients allocated to each of them being predetermined as a function of said attitude.

The invention will be more readily understood on reading the following description with reference to the accompanying drawings, in which.

Figure 1:
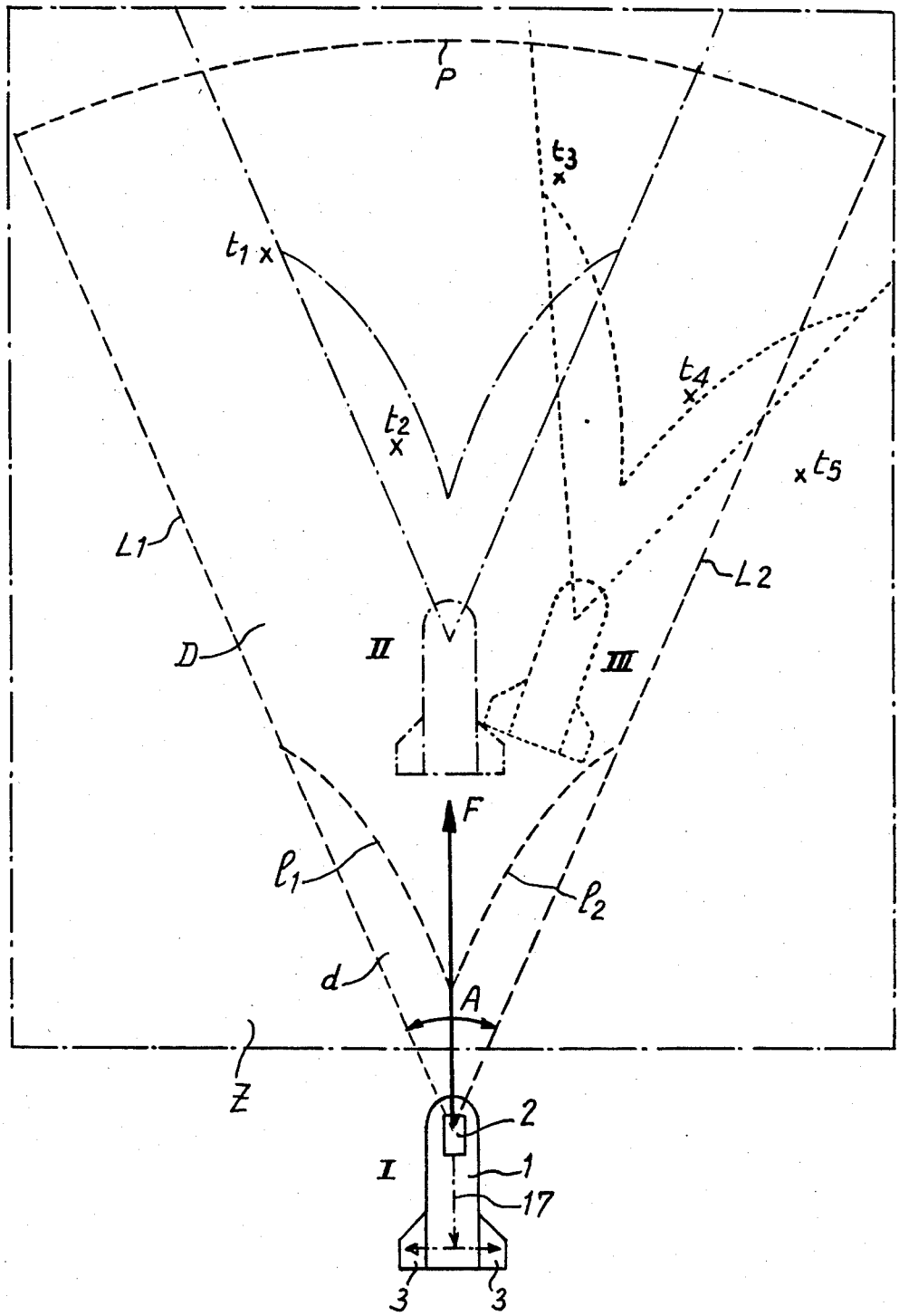
FIG. 1 is a schematic plan view illustrating the operation of the guiding system according to the present invention.

Referring now to the drawings, FIG. 1 very schematically shows a missile 1 intended to reach a target $t_i$ (with $i=1, 2, 3, \ldots, n$) chosen from several targets t1, t2, t3, t4, t5, . . . located in a geographical zone Z, in which they may possibly move around.

Missile 1 is provided with a guiding system 2 and steering controls 3, for example aerodynamic ailerons, adapted to be controlled by said guiding system 2 to act on the direction of advance F of said missile.

As will be seen hereinbelow, the guiding system comprises observation means, constituted by an electronic-scanning antenna 4, and computer means 5 intended for processing the information delivered by the antenna 4 and for controlling the steering controls 3.

Antenna 4 scans a limited portion of space, laterally, by two divergent lines L1 and L2 corresponding to the scanning amplitude A of said antenna. Since, moreover, said observation means of missile 1 have a maximum range depending on their inherent characteristics, the range of action D of said missile at a given instant is therefore at maximum a sector defined by lines L1 and L2 and by the portion of circle P centred on the instantaneous position of the missile and of which the radius corresponds to said maximum range. However, due to its limited manoeuvrability, missile 1 cannot immediately reach the portions of lines L1 and L2 which are close thereto, with the result that said range of action D is in addition amputated, just in front of said missile, by a zone d which is defined by lines L1 and L2 and by curves 11 and 12 and inside which it is not possible to conduct the missile.

At a given instant of flight of missile 1, the range of action D thereof is thus constituted by the portion of sector defined by lines L1, L2, l1, l2 and P.

Of course, as missile 1 advances, lines L1, L2, l1 and l2 move with the missile, with the result that the geographical zone on which the range of action is superposed modifies continuously. FIG. 1 shows that, in position (I), the range of action D of missile 1 is sufficiently vast to cover targets $t_1$, $t_2$, $t_3$ and $t_4$ (target $t_5$ already having left range D), whilst, for position II of said missile, range D is so restricted that only target t3 remains therewithin, targets $t_1$ and $t_4$ having left laterally through lines L1 and L2 and target $t_2$ then being located in range d.

It will be noted that said targets leave systematically as missile 1 advances, even in the event of said targets being fixed. When the targets are mobile and move in zone Z, it goes without saying that their departure from range D may be advanced or delayed depending on the trajectories that they follow.

It is a principal object of the present invention to guide missile 1 so that targets $t_i$ remain as long as possible within the range of action D, so that the guiding system 2 has an optimum period of time available to effect the operations for classifying said targets by order of importance, in order, at each instant, to allow departure from the range of action D only of the or each target which is not the most important (or top priority) and, finally, to guide missile 1 towards the most important target.

Figure 2:
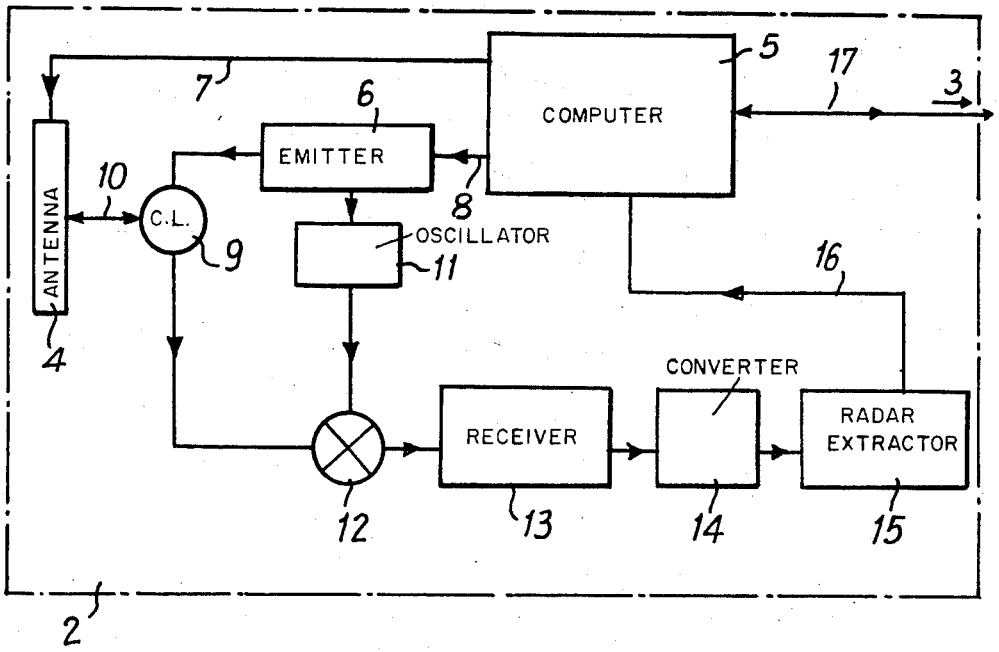
FIG. 2 shows the block diagram of the guiding system according to the present invention.

The embodiment, shown in FIG. 2, of the guiding system 2 according to the invention comprises an electronic-scanning antenna 4 emitting and receiving the V.H.F. signals for detecting targets $t_i$, as well as a computer 5 and an emitter 6 of said signals. Computer 5 controls antenna 4 thanks to link 7 and emitter 6 thanks to link 8. Emitter 6, operating for example in X- or Ku-band, may be of the impulse emitter (magnetron) or impulse compression system type. The signals that it emits may be coherent or not.

The signals from emitter 6 are addressed to antenna 4 via a circulator-limiter 9 and a link 10. Inversely, the signals received by antenna 4 are addressed by the latter to said circulator-limiter 9 through said link 10. A single V.H.F. link 10 is thus provided between antenna 4 and said circulator-limiter 9.

Furthermore, guiding system 2 comprises a local oscillator 11 effecting transposition of the V.H.F. signals received by antenna 4 into signals of medium frequency, via a mixer 12. These medium-frequency signals are transmitted to a receiver 13 which filters them, detects them and amplifies them. To that end, the receiver 13 may comprise an automatic gain control amplifier. However, it is preferable if said amplifier is of the logarithmic type so that high instantaneous dynamics can be available (higher than 70 dB).

The video analog signals coming from receiver 13 are transmitted to an analog-to-digital converter 14, which converts them into digital signals. Converter 14 is preferably rapid (of the flash type with a sampling frequency higher than 20 MHz) and delivers a coded signal with at least six bits.

These digital signals are transmitted to a radar extractor 15 which memorizes them after having effected a pre-processing (averaging, comparison with thresholds, . . . ). This extractor 15 may be constituted by a wired rapid processing unit (adders, comparators, logic gates, . . . ) and by a dynamic rapid access memory.

Computer 5 ensures management of the whole of the system and it exploits the data memorized by extractor 15, with which it is connected by bus 16, in order to carry out the operations of tracking and classification according to the invention. This results in orders transmitted to missile 1 and in particular to steering controls 3 via a digital bus 17 and controls intended for the electronic-scanning antenna 4 (via link 7). Computer 5 also ensures, via bus 16, dialogue with the missile during the initialization phase of the homing head. It may, furthermore, monitor operation of the emitter (instant of emission, control of the type of emission, etc.) by link 8.

Figure 3:
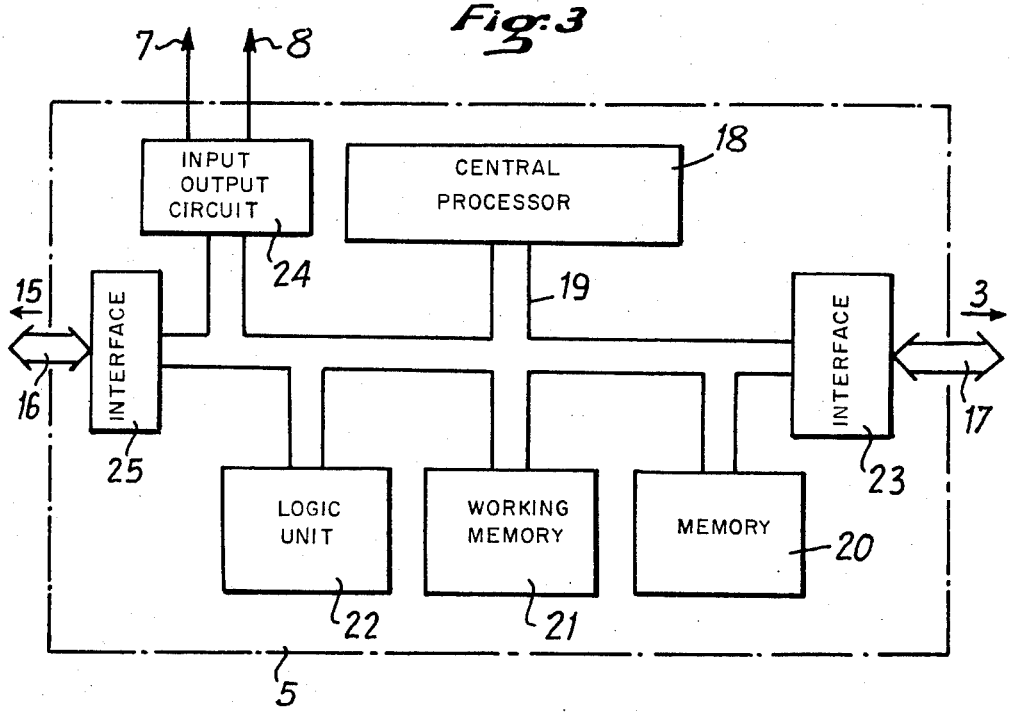
FIG. 3 shows the block diagram of the computer for the guiding system according to the present invention.

In the embodiment shown in FIG. 3, computer 5 comprises a central unit 18, for example constituted by a management microprocessor with 16 or 32 bits, which, via a bus line 19, is linked with:

a memory 20, for example a ROM, containing the software and pre-recorded electronic images of potential targets;

a working memory 21, for example a read/write memory, for temporarily storing the data;

a rapid arithmetical and logic unit 22;

an interface circuit 23 for bus 17;

an input-output circuit 24 for links 7 and 8 within system 2; and an interface circuit 25 with the extractor bus 16 connecting computer 5 to extractor 15.

Figure 4:
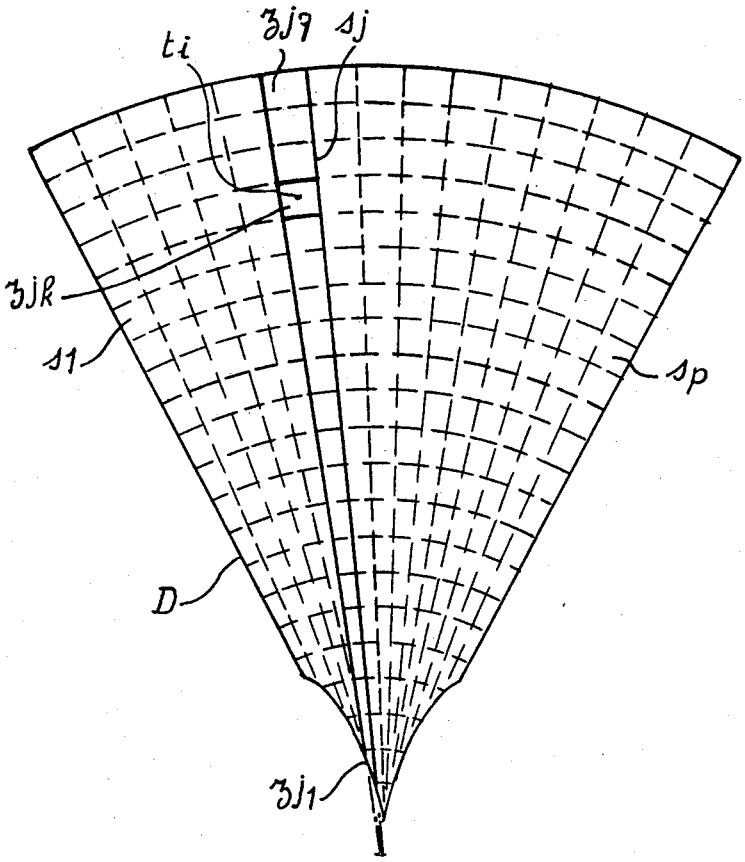
FIG. 4 illustrates the scanning of the range of action of the missile by the electronic-scanning antenna.

As shown in FIG. 4, at a given instant, computer 5 controls antenna 4 so that it scans an elementary sector sj of the range of action D, selected from a plurality p of adjacent elementary sectors sl to sp (with j=1, 2, 3, . . . p) covering the whole of said range of action D. In order to avoid jamming of the scanning of antenna 4 as far as possible, the range of action D is preferably not scanned in the order of sectors from sl towards sp, but in random manner.

Furthermore, computer 5 fictitiously subdivides each elementary sector sj, along the radius thereof, into a plurality g of adjacent elementary zones zj1 to zjq covering the whole of said sector sj.

In this way, the range of action D is fictitiously subdivided into a plurality pxq of elementary zones zjk (with k=1, 2, 3, . . . q) scanned successively, in sequences imposed by computer 5, by said antenna 4.

Antenna 4, controlled by computer 5 via link 7 and supplied by emitter 6 via link 10, receives in return the echo from targets $t_i$ and, via chain 9, 10, 12, 13, 14, 15 and 16, this echo is addressed to computer 5, which thus knows in which elementary zone zjk each target $t_i$ is located.

Of course, it is indispensable that, at each instant, computer 5 modifies the indices j and k of the elementary zones zjk in order to take into account the advance (arrow F) and possible changes in direction of said missile 1.

The continual updating of indices j and k as a function of the advance of the missile is automatically taken into account by computer 5. Moreover, as the changes in direction of the missile are imposed thereon by system 2 (via link 17 and steering controls 3), computer 5 knows them and can continuously modify said indices j and k in appropriate manner as a function of said changes in direction.

In this way, computer 5 knows with precision, at each instant, the position of each target $t_i$ in its range of action D.

At this stage of scanning, computer 5 may make a pre-selection of targets $t_i$ and, for the following process, may take interest, for example, only in those targets of which the amplitude of the echo exceeds a predetermined threshold, i.e. in the largest targets. In this way, in FIG. 1 for example, it has been assumed that, in position (I), guiding system 2 has voluntarily allowed target $t_5$ to leave its range of action D (through line L2), because the amplitude of the echo of this target $t_5$, determined for a position of missile 1 prior to position (I) (and not shown), proved less than said predetermined threshold.

Since computer 5 knows at each instant the position of each target $t_i$, it may follow the displacements of said targets under the action of their own means of propulsion. In fact, from one scanning to the following made by antenna 4, a mobile target $t_i$ will pass from one elementary zone zjk to an elementary zone adjacent or close thereto.

Computer 5 therefore follows, within its range of action 5, the displacement of targets $t_i$, as a function of its own advance and its own changes in direction. It therefore knows, at each instant, those of targets $t_i$ which are on the point of leaving its range of action D through lines L1, L2, 11 and 12.

Simultaneously to the operations of position determination described hereinabove, computer 5 effects operations of classification of said targets $t_i$. To this end, it compares the echos received by antenna 4, i.e. the electronic images of said targets, with electronic images of potential targets recorded in memory 20. These pre-recorded images are classified by order of decreasing priority.

Computer 5 thus knows, at each instant, the position of each target $t_i$, but determines an order of priority in the destruction of said targets.

Consequently, computer 5 knows whether it may, or may not, allow a target to leave its range of action. For example, in FIG. 1, position (II) of missile 1 corresponds to the fact that, in position (I), guiding system 2 has determined, in addition to the positions of targets $t_1$, $t_2$, $t_3$ and $t_4$, an order of priority whereby target t3 has highest priority. On passing from position (I) to position (II), system 2 has allowed targets $t_1$, $t_2$ and $t_4$ to leave the range of action D.

On the other hand, position (III) of FIG. 1 illustrates the situation in which, in position (I) of the missile, system 2 has determined that the target with highest priority was target $t_4$. Under these conditions, system 2 has modified the direction of advance of missile 1 so that this target $t_4$ remains in the range of action D thereof.

This position (III) of missile 1 also illustrates the case where, computer 5 having already eliminated from its choice targets $t_1$ and $t_2$ having least priority, has not, however, yet finally chosen between targets $t_3$ and $t_4$. Consequently, guiding system 2 has communicated to missile 1 a change in direction making it possible to maintain both targets $t_3$ and $t_4$ in the range of action D for as long as possible so that computer 5 has an optimum time available for making its final choice.

When the target of highest priority has finally been determined, the guiding system according to the invention passes into phase of final tracking thereof, with for example a scanning frequency by antenna 4 higher than in guiding phase.

In the favourable case of it being possible, thanks to the comparison of the electronic images of the target of highest priority with the pre-recorded electronic images, to determine the attitude of this target with respect to the missile, a point of impact different from the brightest point of the target may be chosen, for example in accordance with criteria such as those mentioned hereinabove.

What is claimed is:

1. In a system for guiding a missile intended to reach a target chosen from several targets located in a geographical region where they may move about, this system comprising observation means scanning a range of action of which the lateral limits are determined by the possibilities of scanning of said observation means and by the manoeuvring possibilities of said missile and of which the limit in depth is at the most equal to the maximum range of said observation means, as well as computer means for processing the information delivered by said observation means, said missile being provided with steering controls adapted to be controlled by said computer means, said observation means are of the type with electronic scanning antenna and successively and permanently scan the whole of a plurality of elementary zones fictitiously subdividing that part of said geographical region covered at each instant by said range of action;

said computer means are associated with memory means in which are pre-recorded the electronic images of potential targets classified by order of decreasing priority;

said computer means determine the positions of the targets located at each instant in said range of action;

said computer means act on the steering controls of said missile to cause said range of action to slide with respect to said geographical region in order to delay the departure from the range of observation of at least certain of the targets reaching the lateral limits thereof;

said computer means continuously classify the targets located in said geographical region by comparing the electronic images thereof furnished by said observation means with said pre-recorded images; and finally, said computer means act on said steering controls to guide said missile towards the target of highest priority determined by said classification.

2. The system of claim 1, wherein, prior to determining the trajectories followed by the targets, said computer means effect a pre-classification of the targets by order of importance.

3. The system of claim 1, wherein it comprises a V.H.F. emitter controlled by said computer means and supplying said antenna via a circulator which, furthermore, addresses to said computer means the signal received from said targets by said antenna.

4. The system of claim 1, wherein scanning of said antenna is controlled by said computer means.

5. The system of claim 4, wherein scanning of said antenna is controlled in pseudo-random manner.

6. The system of claim 1, wherein, at least for the potential targets of highest priority, the pre-recorded electronic images correspond to several different attitudes of said targets with respect to the missile.

7. The system of claim 6, wherein the final point of impact of the missile on the priority target is chosen to be different from the brightest point thereof by said system.

8. The system of claim 7, wherein the final point of impact of the missile on the priority target is defined as the barycentre of a plurality of bright points of said target, the coefficients allocated to each of these bright points being determined as a function of said attitude.

9. Missile, wherein it comprises a guiding system of the type set forth in claim 1.

* * * * *